US009259655B2

(12) United States Patent
Snyder et al.

(10) Patent No.: US 9,259,655 B2
(45) Date of Patent: Feb. 16, 2016

(54) SYSTEM AND APPARATUS FOR SILENT ANTI-ROLLBACK FOR TRACK MOUNTED VEHICLES

(71) Applicant: S&S Worldwide, Inc., Logan, UT (US)

(72) Inventors: Todd Snyder, Nibley, UT (US); Mike Worley, Wellsville, UT (US); Quin Checketts, River Heights, UT (US)

(73) Assignee: S&S Worldwide, Inc., Logan, UT (US)

( * ) Notice: Subject to any disclaimer, the term of this patent is extended or adjusted under 35 U.S.C. 154(b) by 305 days.

(21) Appl. No.: 14/070,270

(22) Filed: Nov. 1, 2013

(65) Prior Publication Data

US 2015/0122144 A1 May 7, 2015

(51) Int. Cl.
*A63G 7/00* (2006.01)
*E01B 25/00* (2006.01)

(52) U.S. Cl.
CPC .. *A63G 7/00* (2013.01); *E01B 25/00* (2013.01)

(58) Field of Classification Search
CPC ..... B61K 7/16; B61K 7/02; A63G 7/00; E01B 25/00
USPC ..... 104/249–252
See application file for complete search history.

(56) References Cited

U.S. PATENT DOCUMENTS 2,175,286 A * 10/1939 Finch ..... B61K 7/20 104/257
2,807,220 A * 9/1957 McDowell ..... B61K 7/20 104/258
2,945,454 A * 7/1960 Beck ..... B61K 7/20 104/258
3,128,721 A * 4/1964 McGowan ..... B61K 7/00 104/162
3,807,532 A * 4/1974 Molt ..... B66C 9/18 104/258
3,828,688 A * 8/1974 Bradbury ..... B61K 7/18 104/252
3,924,539 A * 12/1975 Wladis ..... B61K 7/20 104/258
3,944,174 A * 3/1976 Flinn ..... B61K 5/06 104/257
4,080,904 A * 3/1978 Lofink ..... B61K 7/20 104/162
4,325,307 A * 4/1982 Bick ..... B61K 7/18 104/256
4,480,723 A * 11/1984 Ingvast ..... B61K 7/08 104/252

(Continued)

FOREIGN PATENT DOCUMENTS

CN 201186616 Y 1/2009
DE 25 40 547 3/1977

(Continued)

OTHER PUBLICATIONS

Maurer Söhne, MAURERXtendedSC2000, "Spinning Coaster for the perfect Xtended introduction," http://www.maurer-rides.com/files/amusement/pdf/P_SC2000_en.pdf, printed Aug. 27, 2013, 8 pgs.

(Continued)

*Primary Examiner* — Jason C Smith
(74) *Attorney, Agent, or Firm* — John R. Thompson; Stoel Rives LLP

(57) ABSTRACT

An anti-rollback apparatus includes a lock arm, a rod, a pawl, a wheel, and a one-way bearing. The rod member is pivotably coupled to the lock arm and the pawl and one-way bearing are coupled to the rod member. The pawl is shaped to selectively engage teeth on a an anti-rollback plate. The wheel is configured to roll on a surface of the anti-rollback plate. The one-way bearing couples the wheel to the pawl. The one-way bearing allows the wheel to rotate freely in a first direction and locks the wheel in relation to the pawl when the wheel rotates in a second direction to force the pawl to engage the teeth.

18 Claims, 5 Drawing Sheets

(56) References Cited

U.S. PATENT DOCUMENTS

| | | | | | |
|---|---|---|---|---|---|
| 4,498,561 | A * | 2/1985 | Sanders | B61K 7/20 | 104/257 |
| 4,690,064 | A | 9/1987 | Owen | | |
| 4,739,863 | A * | 4/1988 | Stauffer | B61K 7/20 | 104/249 |
| 5,211,115 | A * | 5/1993 | Maier | B61C 13/00 | 104/249 |
| 5,325,790 | A * | 7/1994 | Drayer | B65G 43/06 | 104/249 |
| 5,388,525 | A * | 2/1995 | Bodkin | B61K 7/02 | 104/252 |
| 5,715,756 | A * | 2/1998 | Weigand | A63G 7/00 | 104/249 |
| 5,738,017 | A * | 4/1998 | Behringer | B61K 7/16 | 104/249 |
| 5,836,252 | A * | 11/1998 | Roick | B61K 7/18 | 104/258 |
| 5,947,030 | A * | 9/1999 | Spieldiener | A63G 7/00 | 104/249 |
| 6,152,042 | A * | 11/2000 | Barry | B61K 7/08 | 104/249 |
| 6,155,178 | A * | 12/2000 | Pease | B61K 7/20 | 104/258 |
| 6,513,441 | B1 | 2/2003 | Clerx et al. | | |
| 6,520,298 | B1 * | 2/2003 | Meuters | B61K 7/025 | 104/26.2 |
| 6,659,237 | B1 | 12/2003 | Pribonic | | |
| 7,303,054 | B2 | 12/2007 | Rosner | | |
| 7,594,473 | B2 | 9/2009 | Kitchen et al. | | |
| 7,640,862 | B2 * | 1/2010 | Zamperla | A63G 7/00 | 104/53 |
| 7,836,829 | B2 | 11/2010 | Burger | | |
| 7,918,740 | B2 | 4/2011 | Kitchen et al. | | |
| 7,921,781 | B2 | 4/2011 | Baker et al. | | |
| 8,020,494 | B2 * | 9/2011 | Smith | A63G 7/00 | 104/249 |
| 8,066,576 | B2 | 11/2011 | Threlkel | | |
| 8,517,847 | B2 | 8/2013 | Crawford et al. | | |
| 8,590,473 | B1 * | 11/2013 | Caccamo | B63B 17/00 | 114/258 |
| 2003/0000415 | A1 | 1/2003 | Lamb et al. | | |
| 2007/0062407 | A1 * | 3/2007 | Kickbush | B61K 7/08 | 104/249 |
| 2009/0031914 | A1 * | 2/2009 | Hahn | B61H 9/04 | 104/249 |
| 2010/0083865 | A1 * | 4/2010 | Heyden | B61K 7/20 | 104/249 |
| 2010/0258025 | A1 * | 10/2010 | Brandt | B61K 7/16 | 104/162 |
| 2013/0130817 | A1 | 5/2013 | Barber | | |
| 2015/0122144 | A1 * | 5/2015 | Snyder | B61K 7/16 | 104/249 |

FOREIGN PATENT DOCUMENTS

| | | | |
|---|---|---|---|
| DE | 10 2006 054116 | B3 | 4/2008 |
| JP | 2000 070554 | A | 3/2000 |
| WO | WO 2006/127446 | A1 | 11/2006 |

OTHER PUBLICATIONS

Non-Final Office Action for U.S. Appl. No. 14/080,606, filed Nov. 14, 2013, and mailed from the USPTO on Apr. 29, 2015, 7 pgs.

* cited by examiner

SYSTEM AND APPARATUS FOR SILENT ANTI-ROLLBACK FOR TRACK MOUNTED VEHICLES

TECHNICAL FIELD

The present disclosure relates to anti-rollback systems for track mounted vehicles and more particularly to silent anti-rollback systems.

BRIEF DESCRIPTION OF THE DRAWINGS

The written disclosure herein describes illustrative embodiments that are non-limiting and non-exhaustive. Reference is made to certain such illustrative embodiments that are depicted in the figures, in which.

DETAILED DESCRIPTION OF PREFERRED EMBODIMENTS

Figure 1:
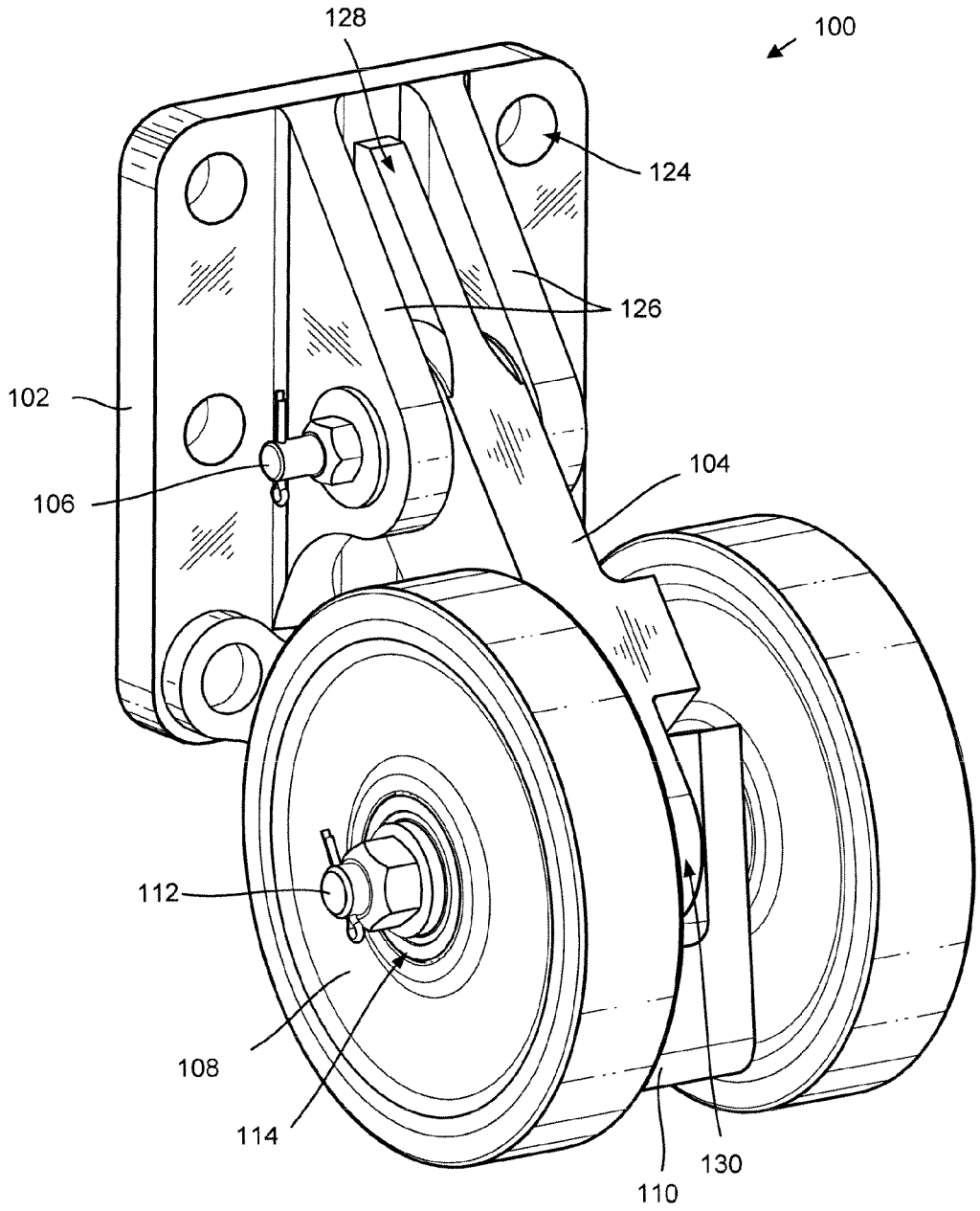
FIG. 1 illustrates an isometric perspective front view of an anti-rollback apparatus consistent with embodiments of the present disclosure.

Track mounted carts or vehicles are often used in amusement rides or for transportation of humans, livestock, goods, or other materials. Wheels on the vehicle or track may be used to reduce resistance to movement of the vehicle. Often, the track mounted carts or vehicles are used to raise a payload along the track. On some amusement rides, for example, a vehicle carrying one or more passengers may be raised along a track to a high point where the vehicle can be released to roll down the track to gain speed and momentum for the amusement ride. The vehicle may be raised using a chain or other structure to move the vehicle against gravity up the track. Because the vehicles are being raised against gravity, a break in the chain or other structure can result in the vehicle falling or moving backwards along the track at dangerous speeds. Harm to human passengers or others nearby, as well as damage to goods, can result from such breakage.

Because of the danger of vehicles falling or sliding backwards down a track, anti-rollback devices and systems are often used to catch or stop the vehicle in the case of a system failure. In fact, anti-rollback systems are sometimes required by law on amusement rides or other track mounted vehicle systems. A number of considerations come into play with anti-rollback systems. One consideration is that the anti-rollback systems must have very low probability of failure. For example, the anti-rollback system must be very likely to operate even in the case of failure of other parts of a vehicle or track, or supporting systems. In many embodiments, it may be desirable that the anti-rollback system work even if there is a loss of electrical power or a failure of a motor or an engine.

Another consideration is that the anti-rollback systems must generally be structurally strong, such that the system can stop a loaded and heavy vehicle at what may be high speeds.

Structures must be sufficiently robust that they are not likely to slip or break under the strain of forces that may be present. Another consideration includes how quickly the anti-rollback system engages in response to the vehicle or cart moving backwards along the track. For example, if the anti-rollback system engages more quickly, the speed and momentum of the vehicle are reduced. Slower speeds and momentum can reduce the likelihood of structural failure, as well as injury to humans or livestock in the vehicle or damage to goods.

Yet another consideration is the level of noise and wear and tear caused on the anti-rollback system when the vehicle is moving in a forward direction without any system failure. For example, in some embodiments, anti-rollback systems operate similarly to a ratchet where a pawl clicks past teeth as the ratchet or teeth move in relation to each other. Thus, a small amount of wear on the pawl and teeth can result with every click even though a vehicle is moving in a proper direction and no system failure has resulted. Additionally, the clicking and repeated impact between the pawl and teeth can cause loud sounds which can be harmful or unpleasant to passengers or operators.

The present application discloses systems, devices, and methods for providing anti-rollback for track mounted vehicles which may address one or more of the considerations discussed above. In one embodiment, for example, a system of the present disclosure provides for dependable and silent anti-rollback on a vehicle for an amusement ride.

In one embodiment, an anti-rollback device includes a pawl, a wheel, and a one-way bearing. The pawl may have a shape to selectively engage teeth on a track mounted plate. The wheel may be configured to roll on a surface of the track mounted plate. The one-way bearing may couple the wheel to the pawl. The one-way bearing may allow the wheel to rotate freely in a first direction and lock the wheel in relation to the pawl when the wheel rotates in a second direction to force the pawl to engage the teeth.

Turning to the figures, FIG. 1 is a perspective front view of one embodiment of an anti-rollback apparatus 100. The apparatus 100 may be mounted on a vehicle or track to prevent the vehicle from moving in a backward direction. In one embodiment, a plurality of anti-rollback apparatus 110 may be used on the same vehicle or track to improve likelihood that a vehicle will be stopped or to increase the amount of force that an anti-rollback system can withstand.

The apparatus 100 includes a bracket 102 for mounting the apparatus to a frame of a vehicle or track. The bracket 102 includes a plurality of holes 124 through which bolts or other fasteners may be inserted to secure the bracket 102 to the vehicle or track. In some embodiments, the bracket may be welded to or built into a frame of a vehicle or track. The bracket 102 may function as a base for other parts of the apparatus 100 to provide a structure for supporting the other parts relative to each other and/or the frame of a vehicle or track.

The bracket 102 is coupled to a lock arm 104. The bracket includes flanges 126 which are pivotably coupled to the lock arm 104 using a lock arm bolt 106. The lock arm bolt 106 secures the lock arm 104 to the bracket 102 while allowing the lock arm 104 to pivot around the lock arm bolt 106 and pivot with respect to the bracket 102. The lock arm bolt 106 may be secured to the bracket 102 and lock arm 104 using threads, a pin, or another mechanism for keeping the lock arm bolt 106 from working free from the apparatus 100. The lock arm includes a first end 128 that limits movement of the lock arm 104 in relation to the bracket 102. For example, the first end 128 limits the lock arm 104 from pivoting past a specific angle with respect to the bracket 102. In one embodiment, if the lock arm is forced in an upwards direction (based on the depicted orientation) to a locked position, the load may be transferred to the bracket 102 via the lock arm bolt 106 and the first end 128 of the lock arm 104.

The lock arm 104 includes a second end 130 that is configured to support mechanisms for engaging stops or teeth on an anti-rollback plate. The second end 130 of the lock arm 104 is coupled to wheels 108 and a pawl 110 of the apparatus 100. The wheels 108 and pawl 110 are coupled to the lock arm 104 using an axle 112.

The axle 112 includes an elongated member which extends through and transverse to the lock arm 104. The axle 112 may extend through a hole of the lock arm. A small amount of friction between the lock arm and the axle 112 may hold the axle 112 in place with respect to the lock arm 104. The axle may include one or more threads, nuts, and/or pins to secure the axle 112 to the wheels 108, pawl 110, and/or the lock arm 104.

The axle 112 may operate as a one-way joint for the wheels 108. In one embodiment, the axle may include a rod member and bearings 114. For example, the wheels 108 may be coupled to the axle 112 using the bearings 114. The bearings 114 may include one-way bearings, which may also be known as clutch bearings, to provide the one-way joint for the wheels 108. In one embodiment, the pawl 110 is secured to the axle 112 in a manner such that the axle 112 and pawl 110 rotate together.

In one embodiment, the pawl 110 is configured to engage stops or teeth on a corresponding anti-rollback plate, which may be mounted to a frame of a track or vehicle. For example, if the anti-rollback apparatus 100 is mounted on a vehicle the anti-rollback plate may be located on a frame of a track on which the vehicle rides. The wheels 108 are placed to ride along a surface, such as a surface on the anti-rollback plate, as the vehicle and track move in relation to each other. In one embodiment, the axle 112 forms a one-way joint that allows the wheels 108 to spin freely in relation to the pawl 110 in one direction while limiting movement of the wheels 108 in relation to the pawl 110 when the wheels 108 rotate in the opposite direction.

Figure 2:
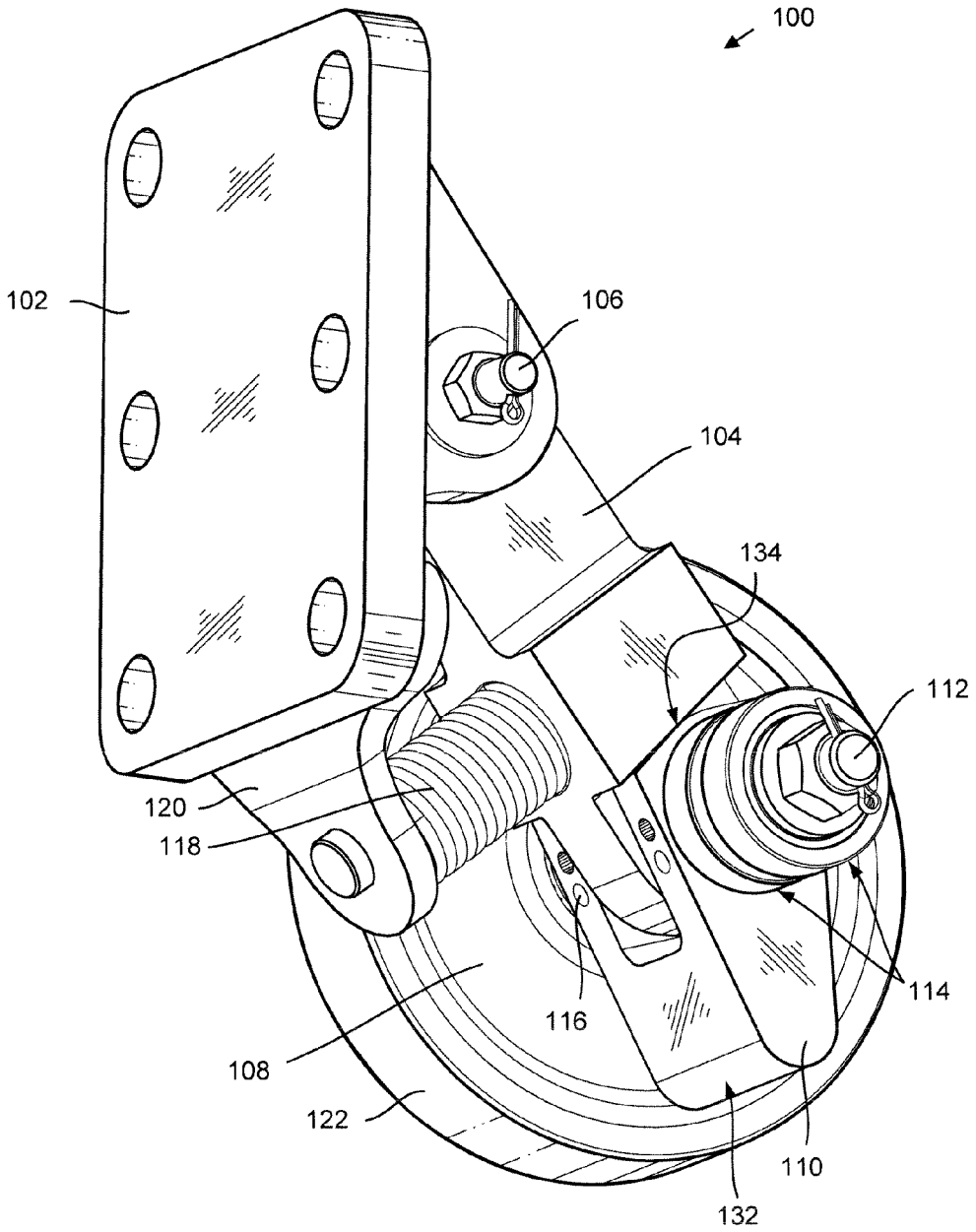
FIG. 2 illustrates an isometric perspective rear view of an anti-rollback apparatus consistent with embodiments of the present disclosure.

FIG. 2 is a perspective rear view of the anti-rollback apparatus 100 of FIG. 1. In FIG. 2 one of the wheels 108 is shown removed to avoid obscuring parts of the apparatus 100. Bolts 116 for securing the pawl to the axle 112 are visible. In one embodiment, the bolts 116 include set screws, or the like, that secure the pawl to the axle 112, such that the pawl 110 is rotatably fixed to the axle 112. For example, as the axle 112 rotates, the pawl 110 may be forced to rotate with it. On the other hand, the bearings 114 allow the wheels 108 to rotate freely with respect to the axle 112 in a first direction but to lock in relation to the axle 112 in a second direction (see FIG. 3).

The apparatus 100 is configured to bias the lock arm 104 and wheels 108 toward a locked position with respect to the bracket 102. Specifically, the apparatus 100 includes a spring 118 and bias bracket 120 to provide a force to hold the lock arm 104 away from the bracket 102 and in a locked position, such that the first end 128 of the lock arm engages the bracket 102 (see FIG. 1). The spring 118 and bias bracket 120 are one example of a bias member that may be used to bias the wheel 108 and/or lock arm 104 away from the bracket 102. In one embodiment, any type of bias member may be used. For example, in one embodiment, a piston or other member used to act as a guide and/or provide a force away from the bracket 102 in place of the spring 118 and/or bias bracket 120. When mounted to a vehicle or track frame, the bias of the lock arm 104 causes the wheels 108 to be biased toward an anti-rollback plate. For example, the wheels 108 are forced against a track frame or surface of an anti-rollback plate. In one embodiment, the wheels 108 include a tread 122 that is configured to provide friction between the wheel 108 and a running surface. For example, the tread 122 may include rubber or other material that provides friction to force the wheels 108 to spin when the wheels 108 are in contact with a surface of the anti-rollback plate and the vehicle is moving in relation to the track. Similarly, the anti-rollback plate or track frame may include a running surface that is smooth and/or has a texture to cause the wheels 108 to spin when they are in contact. Because the spring 118 forces the wheel 108 to contact the running surface, the wheel 108 should be rotating when the vehicle is moving at a location on the track where a running surface is present.

The pawl 110 is shaped to engage stops on an anti-rollback plate or another location. For example, the pawl 110 includes an elongated nose shape on a first end 132 to correspond to teeth (see FIGS. 4 and 5) on an anti-rollback plate. The pawl 110 may be shaped to engage teeth or stops as it moves in a first direction with respect to the stops and slide past the stops as it moves in a second, substantially opposite direction, with respect to the stops. One of skill in the art will recognize that the shape of the first end 132 may vary depending on the shapes or types of stops or teeth the pawl 110 is meant to engage.

The pawl 110 also includes a shape to engage the lock arm 104 on a second end 134. For example, the pawl 110 may be configured to be rotatable on the axle 112 between an engaged and disengaged position. In FIG. 2, the pawl 110 is shown in a disengaged position. The second end 134 of the pawl 110 is configured to cause the pawl 110 to rotate no further than a disengaged position, such as the position illustrated in FIG. 2. The second end 134 may also be configured to transfer a load from the first end 132 of the pawl 110 to the lock arm 104 when the pawl 110 is in an engaged position (see FIG. 5). As depicted in FIG. 2, the second end 134 is shaped to limit the pawl 110 from rotating further than the engaged position with respect to the lock arm 104 and thereby transfer a load to the lock arm 104.

The bracket 102, lock arm 104, pawl 110, axle 112, wheels 108, and or other components of the apparatus 100 may be formed of hardened materials that can handle a load of a given vehicle. For example, the components of the apparatus 100 may include metals, such as hardened steel or other alloys that can hold up under the forces and/or momentum of a falling or backwards-moving vehicle.

In one embodiment, the apparatus 100 can operate to stop a vehicle regardless of the orientation of the apparatus 100 and/or its location with respect to an anti-rollback plate. For example, because the wheels 108 and the friction between the wheels 108 and a running surface cause the pawl 110 to rotate, the pawl 110 can be rotated against gravity toward an engaged position. In fact, a significant amount of force may be generated to ensure that the pawl 110 engages corresponding teeth on an anti-rollback plate. Similarly, because the rotation of the pawl 110 toward the engaged position may be based on movement of the vehicle, the pawl 110 may be dependably rotated to engage stops and stop or slow backward movement.

Figure 3:
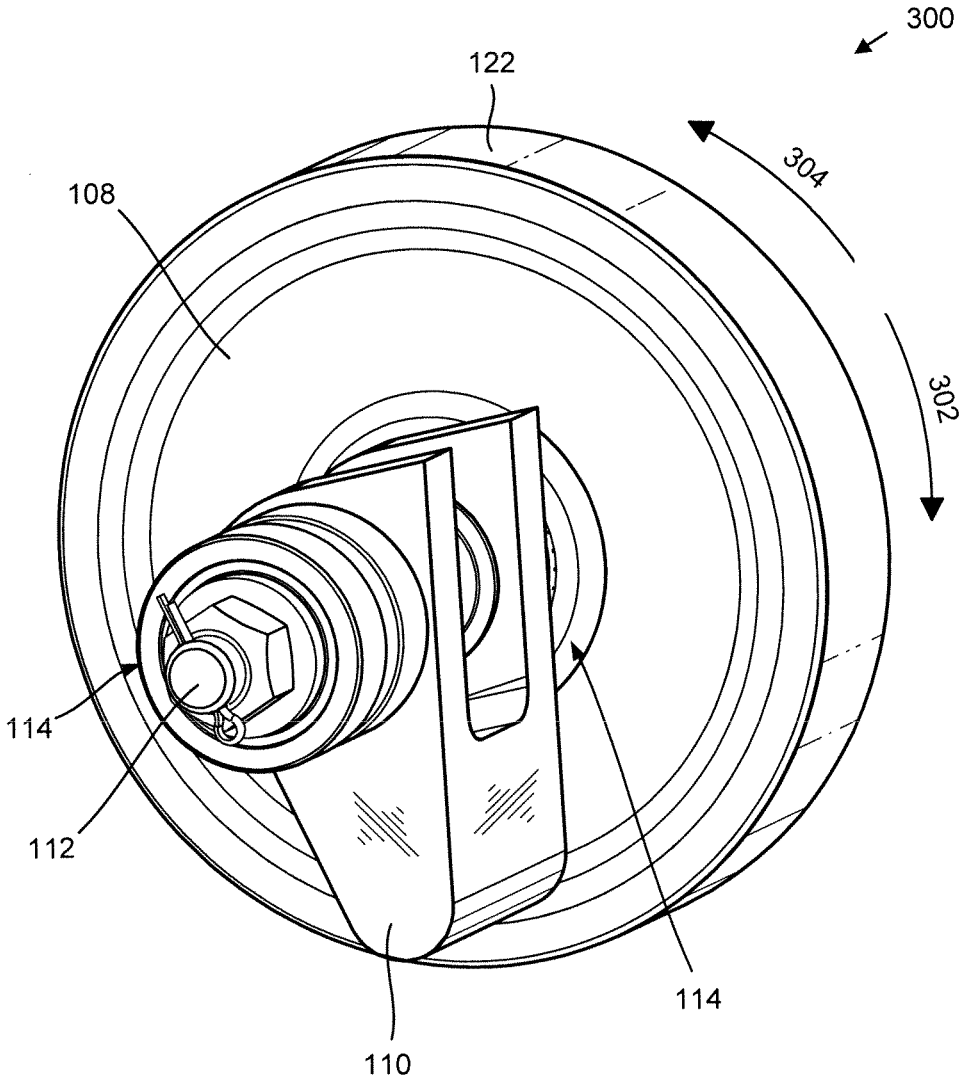
FIG. 3 illustrates an isometric perspective side view of a one-way joint consistent with embodiments of the present disclosure.

FIG. 3 illustrates a perspective side view of a one-way joint 300 with a wheel 108 and pawl 110 coupled to the one-way joint 300. According to one embodiment, two wheels 108 may be used, but one is shown removed to avoid obscuring the one-way joint 300. The one-way joint 300 includes an axle 112 and bearings 114. According to one embodiment, the bearings 114 include one-way bearings that allow a wheel 108 to rotate in a first direction 302 independently of the pawl 110 and axle 112. The one-way bearings may include any type of commercially available one-way bearings. The bearings 114 may lock when the wheel is rotated in a second direction 304, forcing the axle 112 and/or pawl 110 to rotate with the wheel 108. When installed on a vehicle or track, the one-way joint 300 is oriented such that the wheels 108 spin in the first direction 302 when the vehicle moves in a forward direction and spin in the second direction 304 when the vehicle moves in a reverse direction.

In one embodiment, at least a small amount of friction is present between the lock arm 104 and the axle 112 such that the axle 112 and/or pawl 110 do not rotate with respect to the lock arm 104 unless the wheel 108 rotates in the second direction 304. For example, a rubber member between the axle 112 and the lock arm 104 may provide sufficient friction to hold the pawl 110 away from the teeth or stops of an anti-rollback plate so that the pawl does not hit each tooth or stop, causing noise. However, the friction between the lock arm 104 and the axle 112 may be small enough that when the wheel 108 rotates in the second direction 304 the wheel forces the pawl 110, via the bearings 114 and the axle 112, to rotate in the second direction 304 to engage teeth or stops to prevent the vehicle from moving in a backward direction. Similarly, if the pawl 110 is not in a disengaged position while the vehicle is moving in a forward direction, the pawl 110 may be forced toward the disengaged position by stops or teeth to overcome the resistance between the lock arm 104 and the axle 112 and place the pawl 110 in the disengaged position.

Figure 4:
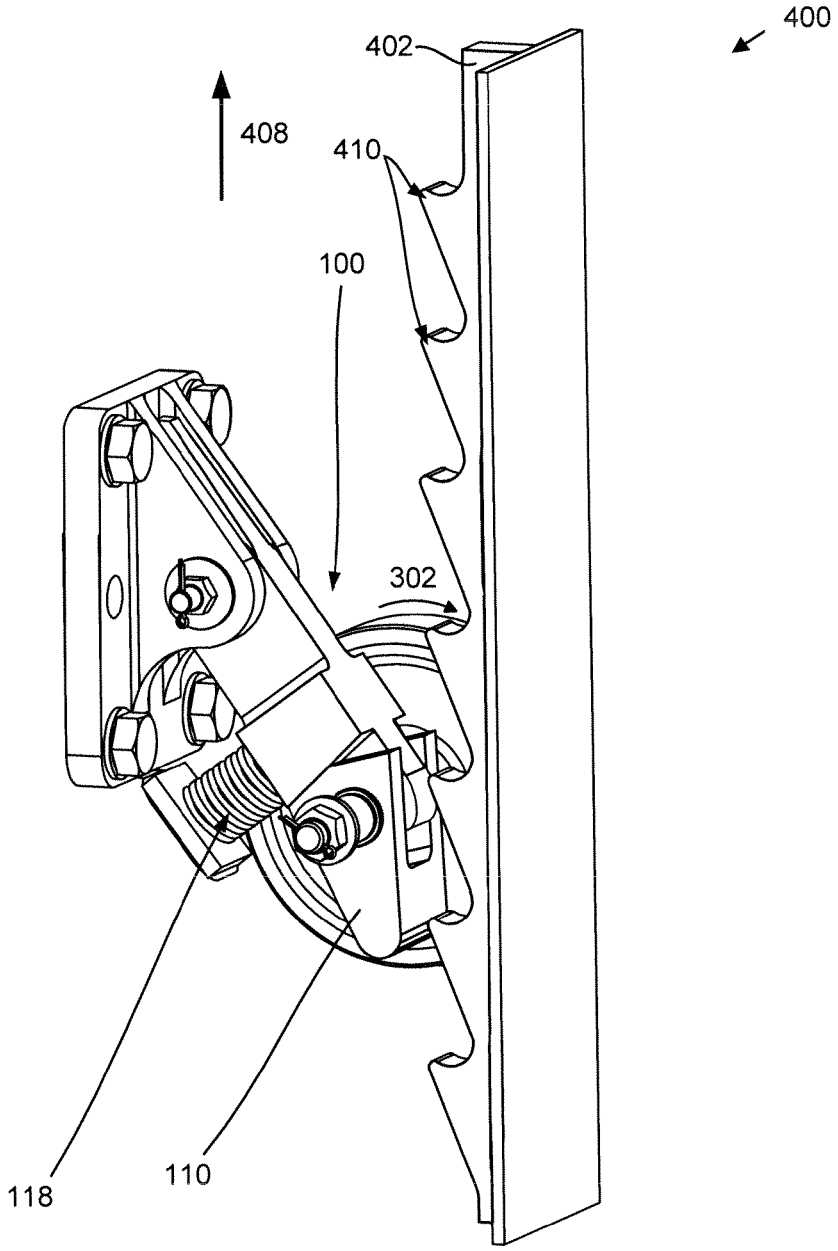
FIG. 4 illustrates an isometric perspective view of an anti-rollback system with a pawl in a disengaged position consistent with embodiments of the present disclosure.
Figure 5:
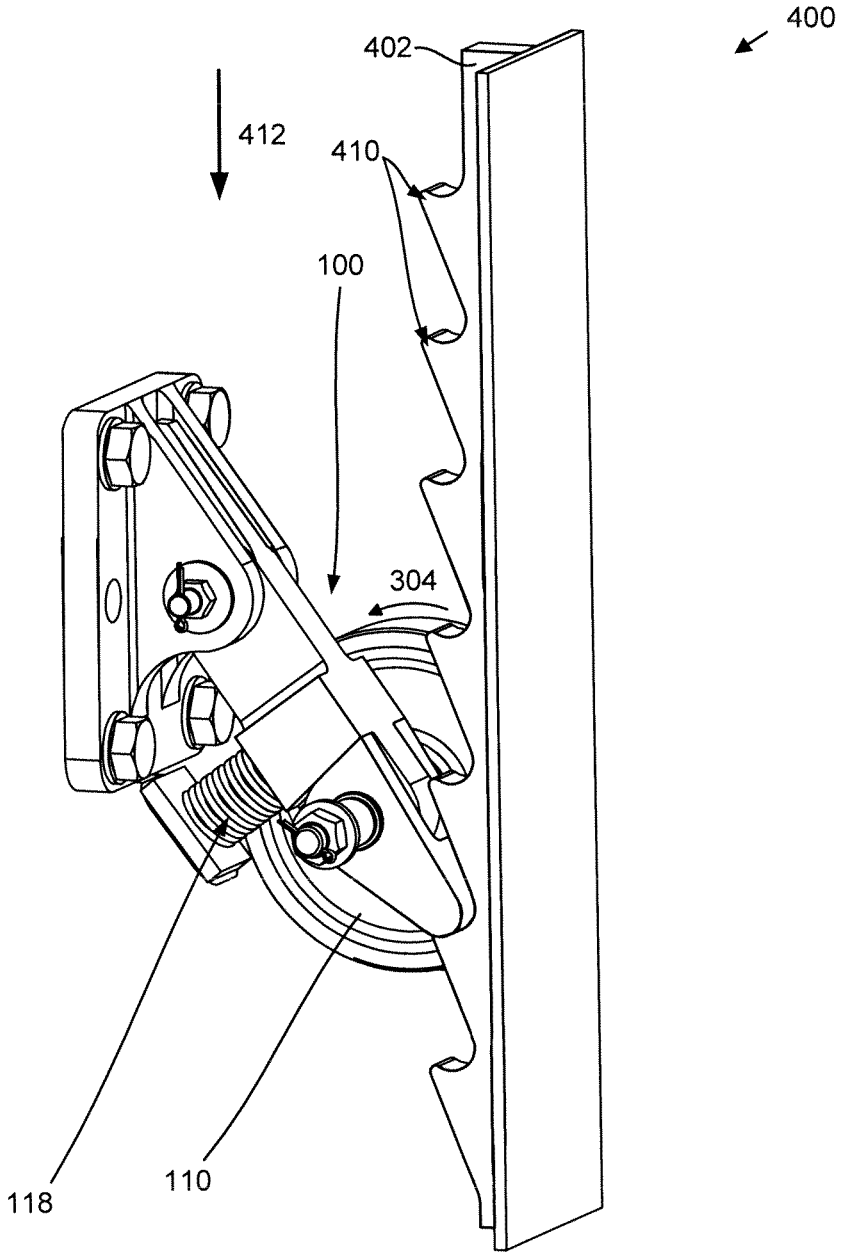
FIG. 5 illustrates an isometric perspective view of an anti-rollback system with a pawl in an engaged position consistent with embodiments of the present disclosure.

FIGS. 4 and 5 illustrate an anti-rollback system 400. The anti-rollback system includes an anti-rollback apparatus 100 and an anti-rollback plate 402. The anti-rollback apparatus 100 is mounted on a vehicle frame (not shown) of a vehicle that is positioned on a track (not shown). The anti-rollback plate 402 may be part of or mounted on a track frame of the track and is positioned to engage the wheels 108 and/or pawl 110 of the anti-rollback apparatus. One of skill in the art will recognize that, in other embodiments, the anti-rollback plate 402 may be located on a vehicle and the anti-rollback apparatus 100 may be located on the track or track frame.

FIG. 4 illustrates a disengaged position of the pawl 110 as the vehicle moves in a forward direction 408. For example, in FIG. 4, a vehicle may be moving up a vertical or sloped track. As the vehicle moves in the forward direction 408, the wheels 108 rotate in a first direction 302. Contact between a running surface on the anti-rollback plate 402 of the track frame forces the wheels 108 to rotate. The running surface and teeth 410 of the anti-rollback plate 402 are positioned parallel to each other. Due to a one-way joint, the pawl 110 and/or axle 112 may not rotate and the pawl 110 remains in a disengaged position. The vehicle moves freely and the pawl 110 does not hit teeth 410 on the anti-rollback plate 402 allowing for silent movement of the vehicle frame 404.

FIG. 5 illustrates an engaged position of the pawl 110 as the vehicle frame moves in a backward direction 412. For example, in FIG. 5, the vehicle may be moving down a vertical or sloped track. As the vehicle moves in the backward direction 412, the wheels 108 rotate in a second direction 304. Contact between the running surface on the anti-rollback plate 402 of the track frame forces the wheels 108 to rotate. Due to the one-way joint, the pawl 110 and/or axle 112 rotate with the wheels 108, forcing the pawl 110 toward an engaged position, as shown. The vehicle is stopped or slowed in the backward movement as the pawl 110 engages the teeth 410.

It will be understood by those having skill in the art that changes may be made to the details of the above-described embodiments without departing from the underlying principles presented herein. For example, any suitable combination of various embodiments, or the features thereof, is contemplated.

Any methods disclosed herein comprise one or more steps or actions for performing the described method. The method steps and/or actions may be interchanged with one another. In other words, unless a specific order of steps or actions is required for proper operation of the embodiment, the order and/or use of specific steps and/or actions may be modified.

Throughout this specification, any reference to "one embodiment," "an embodiment," or "the embodiment" means that a particular feature, structure, or characteristic described in connection with that embodiment is included in at least one embodiment. Thus, the quoted phrases, or variations thereof, as recited throughout this specification, are not necessarily all referring to the same embodiment.

Similarly, it should be appreciated that in the above description of embodiments, various features are sometimes grouped together in a single embodiment, figure, or description thereof for the purpose of streamlining the disclosure. This method of disclosure, however, is not to be interpreted as reflecting an intention that any claim requires more features than those expressly recited in that claim. Rather, inventive aspects lie in a combination of fewer than all features of any single foregoing disclosed embodiment. It will be apparent to those having skill in the art that changes may be made to the details of the above-described embodiments without departing from the underlying principles set forth herein. The scope of the present invention should, therefore, be determined only by the following claims.

The invention claimed is:

1. An anti-rollback apparatus for a track mounted vehicle comprising:
- a lock arm;
- a rod member pivotably coupled to the lock arm;
- a pawl coupled to the rod member, the pawl shaped to selectively engage teeth on an anti-rollback plate;
- a wheel configured to roll on a surface of the anti-rollback plate;
- a one-way bearing coupling the wheel to the rod member, wherein the one-way bearing allows the wheel to rotate freely in a first direction and locks the wheel in relation to the rod and pawl when the wheel rotates in a second direction to force the pawl to engage the teeth;
- a bias member to bias the lock arm toward the anti-rollback plate.

2. The apparatus of claim 1, further comprising a base, wherein the lock arm is pivotably coupled to the base and wherein the bias member biases the lock arm away from the base.

3. The apparatus of claim 1, wherein the lock arm and the pawl are configured to lock in response to the pawl engaging the teeth to decelerate the vehicle.

4. The apparatus of claim 1, wherein a coupling between the rod member and the lock arm comprises sufficient resistance to hold the pawl away from the teeth when the wheel rotates in the first direction.

5. The apparatus of claim 1, wherein the wheel comprises a high-friction material to cause the wheel to spin while rolling on the surface of the anti-rollback plate.

6. An anti-rollback apparatus for use with vehicles that ride on a track, the apparatus comprising:
- a lock arm pivotally mounted on a vehicle frame;
- a bias member biasing the lock arm away from the vehicle frame toward a locked position;
- a pawl configured to selectively engage stops on a track frame;

at least one wheel positioned to ride on a running surface of the track frame; and an axle member pivotally supported on the lock arm, wherein the pawl is coupled to the axle member and the wheel is coupled to the axle member via a one-way joint, wherein the one-way joint allows the wheel to rotate freely in relation to the pawl in a first direction and engages when the wheel rotation is in a second direction to force the pawl toward the stops on the track frame.

7. The anti-rollback apparatus of claim 6, wherein the bias member comprises one or more of a bias bracket and a spring.

8. The anti-rollback apparatus of claim 6, wherein the bias member comprises a piston.

9. The anti-rollback apparatus of claim 6, wherein the lock arm and the pawl are configured to lock in response to the pawl engaging the teeth to decelerate the vehicle.

10. The anti-rollback apparatus of claim 6, wherein a coupling between the axle and the lock arm comprises resistance to hold the pawl away from the teeth when the wheels rotate in the first direction.

11. The anti-rollback apparatus of claim 6, wherein the wheels comprise a high-friction material to cause the wheel to rotate while in contact with the running surface.

12. The anti-rollback apparatus of claim 6, wherein the at least one wheel comprises at least two wheels positioned to ride on two or more running surfaces comprising the running surface.

13. An anti-rollback system comprising:

an anti-rollback plate secured relative to a track, the anti-rollback plate comprising a plurality of stops and a running surface parallel to the plurality of stops; and a vehicle riding on the track, the vehicle comprising an anti-rollback apparatus, the apparatus comprising, a lock arm;

a rod member pivotably coupled to the lock arm;

a pawl coupled to the rod member, the pawl shaped to engage the stops in a reverse direction and slide past the stops in a forward direction;

a wheel configured to roll on the running surface;

a one-way bearing coupling the wheel to the rod member, wherein the one-way bearing allows the wheel to rotate freely in a first direction when the vehicle moves in the forward direction and locks the wheel in relation to the pawl when the wheel rotates in a second direction to force the pawl to engage the stops when the vehicle moves in the reverse direction; and a bias member to bias the lock arm toward the anti-rollback plate.

14. The anti-rollback system of claim 13, further comprising a base, wherein the lock arm is pivotably coupled to the base and wherein the bias member biases the lock arm away from the base.

15. The anti-rollback system of claim 13, wherein the lock arm and the pawl are configured to lock in response to the pawl engaging the stops to decelerate the vehicle.

16. The anti-rollback system of claim 13, wherein a coupling between the rod member and the lock arm comprises sufficient resistance to hold the pawl away from the stops when the wheel rotates in the first direction.

17. The anti-rollback system of claim 13, wherein the running surface comprises a texture to cause the wheel to rotate when the vehicle moves with respect to the track.

18. The anti-rollback system of claim 13, wherein the bias member comprises one or more of a bias bracket, a spring, and a piston.

* * * * *